US005839928A

United States Patent [19]

Nakayasu et al.

[11] Patent Number: 5,839,928

[45] Date of Patent: Nov. 24, 1998

[54] SHIFTING MECHANISM FOR OUTBOARD DRIVE

[75] Inventors: Yoshikazu Nakayasu; Akihiro Onoue, both of Hamamatsu, Japan

[73] Assignee: Sanshin Kogyo Kabushiki Kaisha, Japan

[21] Appl. No.: 748,026

[22] Filed: Nov. 12, 1996

Related U.S. Application Data

[63] Continuation of Ser. No. 652,951, May 24, 1996, abandoned, which is a continuation of Ser. No. 420,655, Apr. 12, 1995, Pat. No. 5,520,559, which is a continuation of Ser. No. 158,611, Nov. 29, 1993, Pat. No. 5,449,306.

[30] Foreign Application Priority Data

Nov. 28, 1992 [JP] Japan ..... 4-341197

[51] Int. Cl.[6] ..... B63H 23/08

[52] U.S. Cl. ..... 440/75; 192/48.7; 416/129; 440/80

[58] Field of Search ..... 440/75, 80, 81; 416/128, 129 RA; 192/48.7, 21, 51; 74/378

[56] References Cited

U.S. PATENT DOCUMENTS

| | | | |
|---|---|---|---|
| 938,911 | 11/1909 | Taylor . | |
| 1,807,254 | 5/1931 | Piano . | |
| 2,064,195 | 12/1936 | Michelis . | |
| 2,347,906 | 5/1944 | Hatcher . | |
| 2,372,247 | 3/1945 | Billing . | |
| 2,672,115 | 3/1954 | Conover . | |
| 2,987,031 | 6/1961 | Odden . | |
| 2,989,022 | 6/1961 | Lundquist . | |
| 3,148,557 | 9/1964 | Shimanckas | 74/378 |
| 4,570,776 | 2/1986 | Iwashita et al. | 192/114 R |
| 4,642,059 | 2/1987 | Nohara . | |
| 4,689,027 | 8/1987 | Harada et al. | 440/75 |
| 4,741,670 | 5/1988 | Brandt . | |
| 4,790,782 | 12/1988 | McCormick . | |
| 4,792,314 | 12/1988 | McCormick . | |
| 4,793,773 | 12/1988 | Kinouchi et al. | 416/129 |
| 4,795,382 | 1/1989 | McCormick . | |
| 4,828,518 | 5/1989 | Kouda et al. . | |
| 4,832,636 | 5/1989 | McCormick . | |
| 4,957,460 | 9/1990 | Harada et al. | 440/75 |
| 4,963,108 | 10/1990 | Koda et al. . | |
| 4,986,774 | 1/1991 | Wantz . | |
| 4,993,848 | 2/1991 | John et al. . | |
| 5,006,084 | 4/1991 | Handa | 440/75 |
| 5,009,621 | 4/1991 | Bankstahl et al. . | |
| 5,030,149 | 7/1991 | Fujita . | |
| 5,186,609 | 2/1993 | Inoue et al. . | |
| 5,230,644 | 7/1993 | Meisenburg et al. . | |
| 5,249,995 | 10/1993 | Meisenburg et al. . | |
| 5,342,228 | 8/1994 | Magee et al. . | |
| 5,344,349 | 9/1994 | Meisenburg et al. . | |
| 5,352,141 | 10/1994 | Shields et al. . | |
| 5,366,398 | 11/1994 | Meisenburg et al. . | |
| 5,449,306 | 9/1995 | Nakayasu et al. . | |
| 5,520,559 | 5/1996 | Nakayasu et al. . | |

FOREIGN PATENT DOCUMENTS

| | | | |
|---|---|---|---|
| 64-28093 | 1/1989 | Japan . | |
| 1-105041 | 4/1989 | Japan . | |
| 1-309890 | 12/1989 | Japan | 440/75 |

*Primary Examiner*—Sherman Basinger

*Attorney, Agent, or Firm*—Knobbe, Martens, Olson & Bear, LLP

[57] ABSTRACT

A shifting mechanism for an outboard drive of a watercraft provides reduced coupling shock when the forward gears are engaged by a dual clutch assembly, as well as provides for consistent and quick engagement of the clutch assembly with the gear. The shifting mechanism involves a first gear and a corresponding first clutch, and a second gear and a corresponding second clutch. A plunger carries the first and second clutches which are arranged on the plunger at unequal distances from their respective gears. This nonuniform spacial relationship between the clutches and gears causes one clutch to engage its corresponding gear before the other clutch engages its corresponding gear. The staggered engagement decreases shock on the transmission and permits quicker engagement between the clutches and gears.

22 Claims, 10 Drawing Sheets

SHIFTING MECHANISM FOR OUTBOARD DRIVE

This application is a continuation of U.S. patent application Ser. No. 08/652,951, filed May 24, 1996, now abandoned which was a continuation of U.S. patent application Ser. No. 08/420,655, filed Apr. 12, 1995, now U.S. Pat. No. 5,520,559, issued May 28, 1996, which was a continuation of U.S. patent application Ser. No. 08/158,611, filed Nov. 29, 1993 now U.S. Pat. No. 5,449,306, issued Sep. 12, 1995.

BACKGROUND OF THE INVENTION

1. Field of the Invention

The present invention relates in general to a marine propulsion system, and more particularly to a shifting system for an outboard drive.

2. Description of Related Art

Many forms of outboard drives employ forward, neutral, reverse transmissions together with a double propeller construction. Such transmissions are common in both outboard motors and in the outboard drive units of inboard-outboard motors.

These transmissions typically include a driving bevel gear and a pair of oppositely rotating driven bevel gears that are journaled within a lower unit of the outboard drive. A front dog clutch of a dual clutch assembly selectively couples an inner propeller shaft to one of the driven bevel gears to rotate a first propeller shaft in a forward or a reverse direction. A rear dog clutch of the clutch assembly selectively couples an outer propeller shaft to the rear driven bevel gear to rotate a second propeller in the forward direction.

A common actuator conventionally engages the clutches with their respective gears. That is, one actuator simultaneously engages the front dog clutch and the front gear, and the rear dog clutch and the rear gear.

A conventional actuator involves a plunger actuated by a cam. A spring, acting on an opposite end of the plunger from the cam, forces the plunger to follow the cam. To engage the front clutch with the front gear and to engage the rear clutch with the rear gear, the spring forces the clutches to engage the gears. To engage the front clutch with the rear gear, the cam forces the front clutch to engage the rear gear.

Several drawbacks are associated with conventional transmissions of the type described above. Simultaneous engagement of the clutches requires synchronized registration of both the teeth of the front clutch and front gear, and the teeth of the rear clutch and rear gear. The teeth of the gears and clutches are not static, however, and synchronization of the teeth is not a constant condition. Under most conditions, the teeth of the clutches and gears are out of phase. Thus, engagement may not be instantaneous, and may not be as quick as the watercraft operator would like.

Additionally, the simultaneous engagement of the front and rear clutches with their respective gears produces a large mechanical shock on the transmission. This mechanical shock accelerates fatigue and wear in the transmission components, as well as in the other component of outboard drive.

SUMMARY OF THE INVENTION

In view of the foregoing drawbacks and shortcomings of the prior shifting mechanism, a need exists for a shifting mechanism which reduces the shock caused by clutch engagement with the gears, and consistently and quickly shifts between the gears, either from forward to reverse or from reverse to forward.

In accordance with one aspect of the present invention, a shifting mechanism for an outboard drive is provided to selectively couple a drive shaft to a first propulsion shaft and to a second propulsion shaft. The shifting mechanism includes first and second counter-rotating gears. The shifting mechanism also includes a first dog clutch coupled to the inner propulsion shaft and adapted to engage the first gear, and a second dog clutch coupled to the outer propulsion shaft and adapted to engage the second gear. A shift linkage of the shifting mechanism is coupled to the first dog clutch and to the second dog clutch. The shift linkage is adapted to move the first dog clutch from a position of nonengagement to a position of engagement with the first gear and to move the second dog clutch from a position of nonengagement to a position of engagement with the second gear. The shift linkage is also arranged to effect engagement of one of the dog clutches before the other of the dog clutches.

In a preferred embodiment, the shifting linkage is adapted to move the first dog clutch through a first distance between the positions of engagement and nonengagement, and to move the second dog clutch through a second distance between the positions of engagement and nonengagement. The first distance is advantageously unequal to the second distance to provide engagement of one dog clutch before engagement of the other dog clutch.

Another preferred embodiment involves the shift linkage having an actuator which carries the first and second dog clutches. One of the dog clutches is resiliently coupled to the actuator to provide engagement of one dog clutch before the other dog clutch.

In accordance with another aspect of the present invention, a shifting mechanism for an outboard drive of a watercraft comprises a first gear and a corresponding clutch, and a second gear and a corresponding clutch. A shift linkage couples the first clutch and second clutch together. In a position of nonengagement, the shift linkage selectively separates the first clutch from the first gear by a first distance and selectively separates the second clutch from the second gear by a second distance. The first and second distances are unequal. This nonuniform spacial relationship between the first gear and the first clutch, and the second gear and the second clutch, causes one of the clutches to engage the corresponding gear before the other clutch engages its corresponding gear. The staggered engagement decreases the shock on the shifting mechanism, and permits quicker engagement between the clutches and gears because mutual, simultaneous engagement of the clutches with the gears is not required.

In a preferred embodiment, the second distance is greater than the first distance such that the first clutch engages the first gear before the second clutch engages the second gear. Alternatively, the first distance is greater than the second distance such that the second clutch engages the second gear before the first clutch engages the first gear.

The clutches are desirably dog clutches having axially extending teeth which correspond to axially extending teeth on the respective gears. Where the second distance is greater than the first distance, it is preferred that the corresponding teeth of the first gear and the first clutch are longer than the corresponding teeth of the second gear and second clutch. Alternatively, where the first distance is greater than the second distance, it is preferred that the corresponding teeth of the second gear and the second clutch are longer than the corresponding teeth of the first gear and the first clutch.

In accordance with another aspect of the present invention, a shifting mechanism for an outboard drive of a watercraft includes a first gear and an opposing second gear. A first clutch is interposed between the gears, and a second clutch is positioned on an opposite side of the second gear from the first clutch. A shift linkage couples the first clutch and second clutch together. The shift linkage is adapted to positively move the first clutch from a first position, in which the first clutch engages the second gear, to a second position, in which the first clutch engages the first gear.

In the preferred embodiment, the shift linkage comprises a plunger which carries the first and second clutches. The shift linkage additionally includes an actuator which is directly connected to the plunger. The actuator positively reciprocates the plunger between the first and second positions to engage the first clutch with either the second gear or the first gear, respectively. The first clutch is desirably connected to a first propulsion shaft which is coupled to a first propeller. Similarly, the second clutch is connected to a second propulsion shaft. The second propulsion shaft is coupled to a second propeller.

In accordance with yet another aspect of the present invention, a transmission for a marine outboard drive includes a first driven gear and a corresponding first clutch coupled to a first propulsion shaft. A second clutch is positioned with the first driven gear interposed between the first clutch and a second clutch. The first driven gear is supported by a first bearing assembly. The propulsion shaft extends through a bearing carrier along a drive axis with a second bearing assembly journalling a portion of the first propulsion shaft within the bearing carrier. The first propulsion shaft includes at least one thrust flange positioned between the first bearing assembly and a third bearing assembly. The thrust flange of the first shaft is arranged to act against the first bearing assembly and against the third bearing assembly to take thrust loadings in opposite axial directions.

BRIEF DESCRIPTION OF THE DRAWINGS

These and other features of the invention will now be described with reference to the drawings of a preferred embodiment which is intended to illustrate and not to limit the invention, and in which.

DETAILED DESCRIPTION OF A PREFERRED EMBODIMENT

Figure 1:
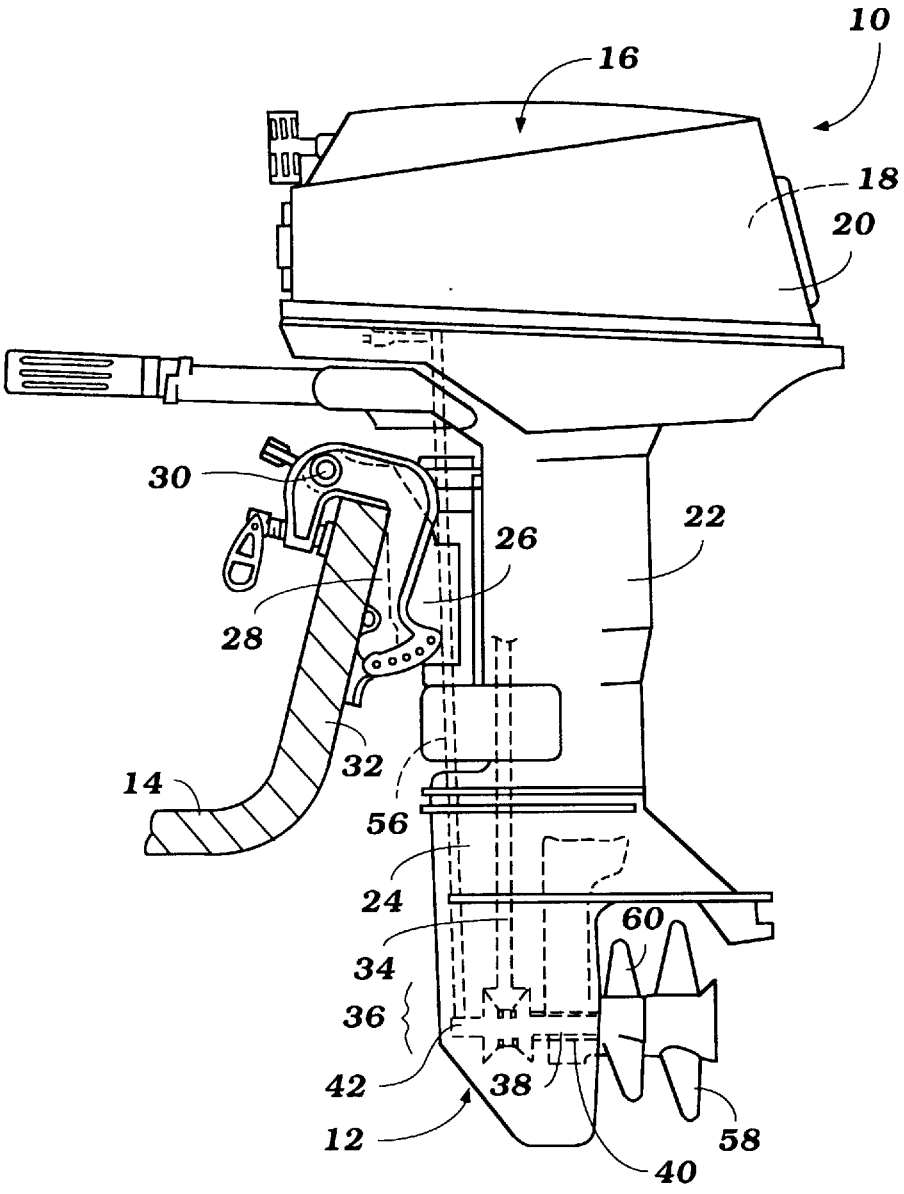
FIG. 1 is a side elevational view of a marine outboard motor incorporating a shifting mechanism in accordance with a preferred embodiment of the present invention.

FIG. 1 illustrates a marine outboard drive 10 which incorporates a shifting mechanism 12 configured in accordance with a preferred embodiment of the present invention. In the illustrated embodiment, the outboard drive 10 is depicted as an outboard motor mounted on the stern of a watercraft 14. It is contemplated, however, that those skilled in the art will readily appreciate that the present shifting mechanism 12 can be applied to an outboard drive unit of an inboard-outboard motor as well.

For the purpose of describing the invention, a coordinate system is provided having mutually orthogonal coordinates oriented as follows: A "longitudinal" coordinate extending in a direction between a bow and a stern of a watercraft 14; a "lateral" coordinate extending in the direction between a port side and a starboard side of the watercraft and intersecting the longitudinal coordinate at right angles; and a "vertical" component orthogonal to both the longitudinal coordinate and the lateral coordinate. Additionally, as used herein, "front" and "rear" are used in reference to the bow (not shown) of the watercraft 14.

In the embodiment illustrated in FIG. 1, the outboard drive 10 has a power head 16 which includes a motor 18 (e.g., an internal combustion engine) that is surrounded by a protective cowling 20 of a known type. An intermediate housing 22 depends from the power head 16 and terminates in a lower unit 24.

A steering bracket 26 is attached to the intermediate housing 22 in a known matter. The steering bracket 26 is also pivotably connected to a clamping bracket 28 by a pin 30. The clamping bracket 28, in turn, attaches to the transom 32 of the watercraft 14. This conventional coupling permits the outboard drive 10 to be pivoted relative to the steering bracket 26 for steering purposes, as well as to be pivoted relative to the pin 30 to permit adjustment to the trim position of the outboard drive 10.

Although not illustrated, it is understood that a conventional hydraulic tilt and trim cylinder assembly, as well as a conventional hydraulic steering cylinder assembly could be used as well with the present outboard drive 10. It is also understood that the above description of the construction of the outboard drive is conventional, and, thus, further details of the steering, trim, and mounting assemblies are not necessary for an understanding of the present shifting mechanism 12.

With reference to FIG. 1, the motor 18 drives a drive shaft 34 that extends through and is journaled within the intermediate housing 22. The drive shaft 34 is desirably aligned along the vertical axis. It should be appreciated, however, that the present outboard drive 10 can have a drive shaft 34 which is skewed from the vertical axis as well.

A transmission 36 of the shifting mechanism 12 selectively couples the drive shaft 34 to an inner propulsion shaft 38 and to an outer propulsion shaft 40. The transmission 36 advantageously is a forward, neutral, reverse-type transmission. In this manner, the drive shaft 34 drives the inner and outer propulsion shafts 38, 40, which rotate in a first direction or in a second counter direction, respectively, as described below in detail.

The propulsion shafts 38, 40, drive a propulsion device, such as, for example, a propeller, a hydrodynamic jet, or the like In the illustrated embodiment, the propulsion device is a counter-rotational propeller device that includes a first propeller 58 designed to spin in one direction and to assert a forward thrust, and a second propeller 60 designed to spin in the opposite direction and to assert a forward thrust. The counter-rotational propeller device will be explained in detail below.

Figure 2:
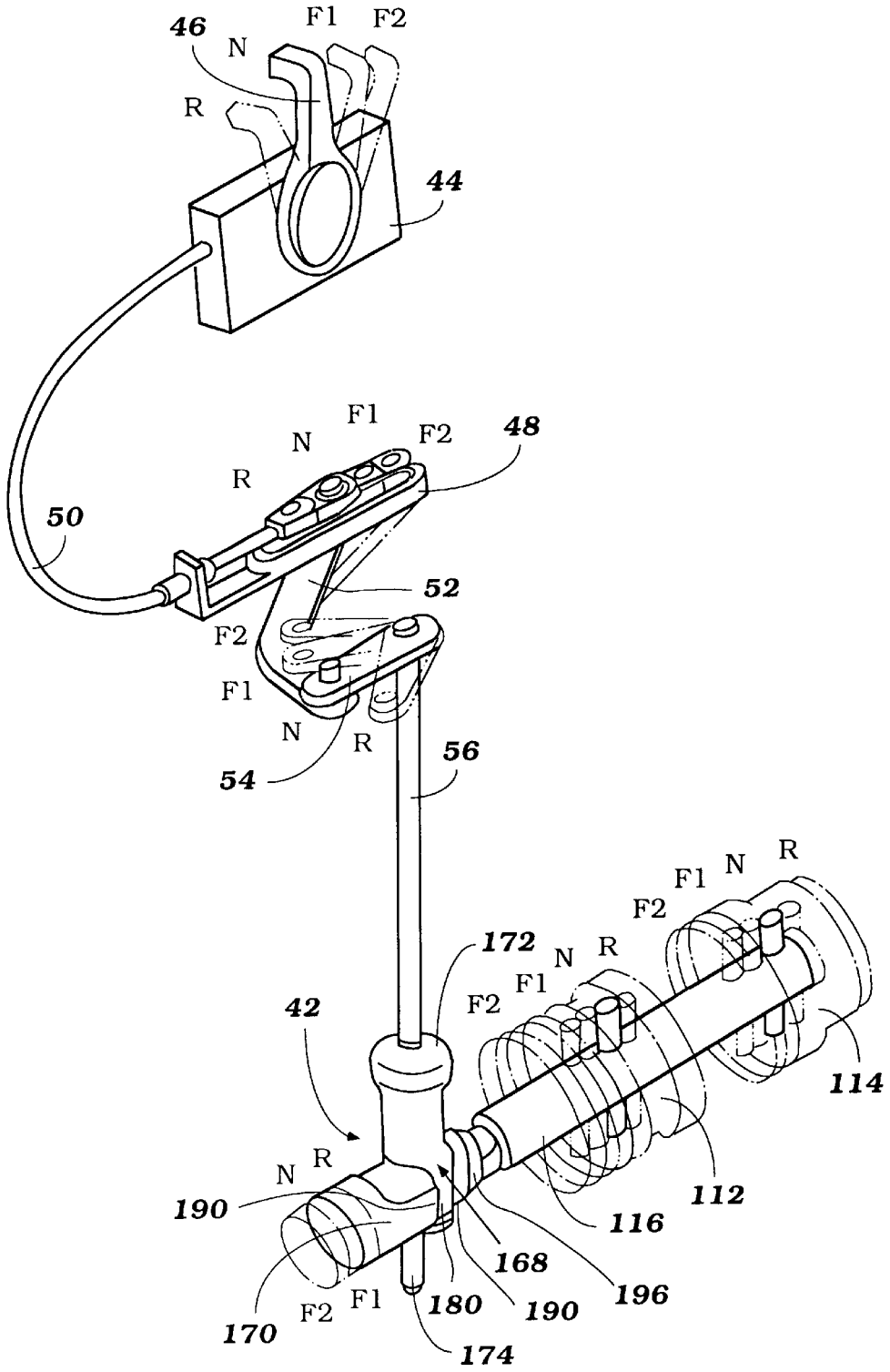
FIG. 2 is a perspective schematic illustration of a clutch assembly and an actuator mechanism of the shifting mechanism of FIG. 1.

An actuator mechanism 42 of the shifting mechanism 12 controls the transmission 34. With reference to FIG. 2, the shifting mechanism 12 includes a gear shifter 44 which is coupled to the actuator mechanism 42. The gear shifter 44 is mounted conventionally, proximate to the steering controls (not shown) of the watercraft 14, and includes a shift lever 46. The shift lever 46 is coupled to a conventional shift slider 48 via a bowden wire cable 50. The shift slider 18 connects to a lever arm 52, which in turn connects to one end of a link 54. An opposite end of the link 54 is fixed to a shift rod 56 so as to move the actuator mechanism 42 in response to movement of the shift lever 46, as known in the art. The actuator 42, in response, controls the transmission 42, as discussed below.

The individual components of the shifting mechanism 12 will now be described in detail.

Transmission Gearset

Figure 3:
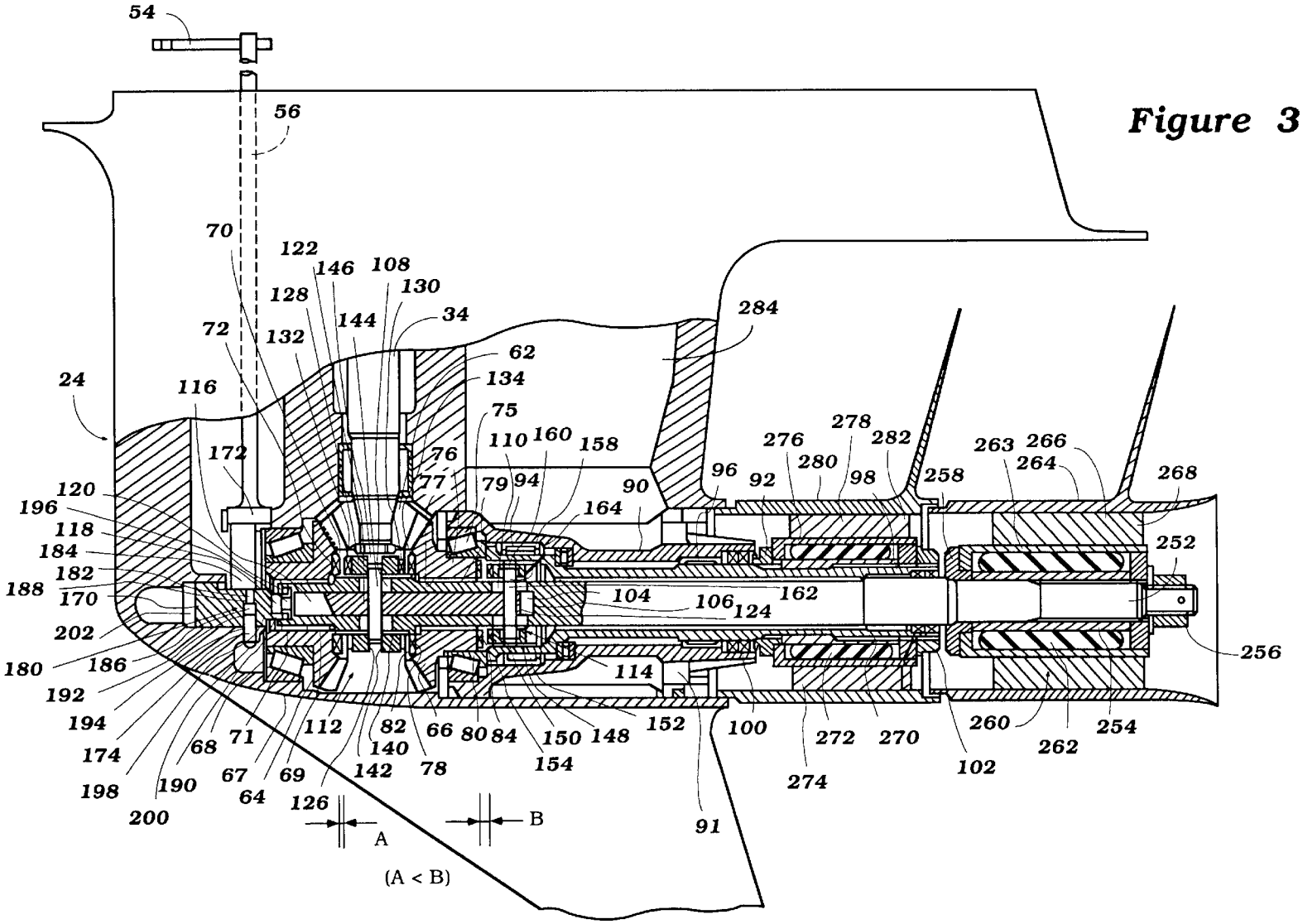
FIG. 3 is a partial sectional side elevational view of the shifting mechanism of FIG. 1.

FIG. 3 illustrates a lower portion of the drive shaft 34 and the transmission 36. The drive shaft 34 carries a drive gear 62 at its lower end, which is disposed within the lower unit 24 and which forms a portion of the transmission 36. The drive gear 62 preferably is a bevel gear.

The transmission 36 also includes a pair of counter-rotating driven gears 64, 66, that are in mesh engagement with the drive gear 62. The pair of driven gears 64, 66, are preferably positioned on diametrically opposite sides of the drive gear 62, and are suitably journaled within the lower unit 42, as described below. Each driven gear 64, 66 is positioned at about a 90° shaft angle with the drive gear 62. That is, the propulsion shafts 38, 40 and the drive shaft 34, desirably intersect at about a 90° shaft angle; however, it is contemplated that the drive shaft 34 and the propulsion shafts 38, 40 can intersect at almost any angle.

In the illustrated embodiment, the pair of driven gears are a front bevel gear 64 and an opposing rear bevel gear 66. The front gear 64 includes a hub 68 which is journaled within the lower unit 24 by a front thrust bearing 67. The front thrust bearing 67 rotatably supports the front gear 64 in mesh engagement with the drive gear 62.

The hub 68 has a central bore 69 through which the inner propulsion shaft 38 passes when assembled. A bearing 71 journals the inner propulsion shaft 38 within the bore 69 of the front gear hub 68.

Figure 4A:
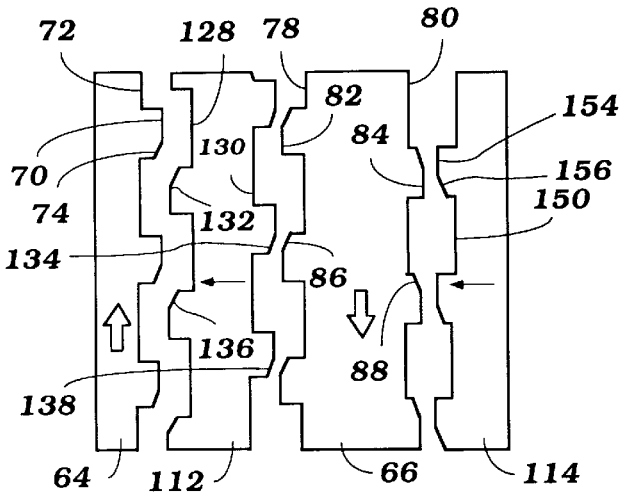
FIG. 4*a* is an abbreviated developed view of corresponding jaws of clutches and gears of the shifting mechanism of FIG. 3, illustrating misalignment between a rear clutch and a corresponding rear gear.

The front gear 64 also includes a series of teeth 70 formed on an annular, rear facing engagement surface 72 which positively engage a portion of a clutch of the transmission 36, as discussed below. The teeth 70 extend from the engagement surface 72 in the longitudinal direction, as well as in a radial direction across the annular engagement surface 72, from the inner diameter to the outer diameter of the engagement surface 72. As best seen in FIG. 4*a*, the teeth 70 advantageously includes chamfers 74 on the trailing edge of each tooth 70 to ease engagement between the teeth 70 and the corresponding clutch, as known in the art.

As seen in FIG. 3, the rear gear 66 also includes a hub 76 which is suitably journaled within the housing of the lower unit 24 by a rear thrust bearing 75. The rear thrust bearing 75 rotatably supports the rear gear 66 in mesh engagement with the drive gear 62.

The hub 76 of the rear gear 66 has a central bore 77 through which the inner propulsion shaft 38 passes when assembled. A bearing 79 journals the inner propulsion shaft 38 within the bore 77 of the second gear hub 76.

The rear gear 66 also includes an annular front engagement surface 78 and an annular rear engagement surface 80. Each engagement surface 78, 80 carries a series of teeth 82, 84 for positive engagement with the clutches of the transmission 36, as known in the art.

Like the teeth 70 of the front gear 64, the teeth 82, 84 of the rear gear 66 extend from the respective engagement surface 78, 80 in the longitudinal direction, as well as in the radial direction across the respective annular engagement surface 78, 80. As best seen in FIG. 4, the teeth 82, 84 advantageously includes chamfers 86,88 on the trailing edge of each tooth 82, 84 to ease engagement between the teeth 82, 84 of the rear gear 66 and the clutches, as known in the art. As FIG. 4 also illustrates, the teeth 84 carried by the rear engagement surface 80 have a shorter axial length than the teeth 82 of the forward engagement surface 78 of the rear gear 66. The rear engagement surface teeth 84 are also shorter than the teeth 70 of the front gear 64.

Propulsion Shaft Assembly

With reference to FIG. 3, the inner propulsion shaft 38 and the hollow outer propulsion shaft 40 are disposed within the lower unit 24. The lower unit 24 also includes a bearing casing 90. The bearing casing 90 rotatably supports the outer propulsion shaft 40, as discussed below. A front end ring 91, attached to the lower unit 24, secures the bearing casing 90 to the lower unit 24.

A front bearing 94 journals the outer propulsion shaft 40 within the bearing casing 90. A needle bearing 96 supports the outer propulsion shaft 40 within the bearing casing 90 at an opposite end of the bearing casing 90 from the front bearing 94.

The inner propulsion shaft 38, as noted above, extends through front gear hub 68 and the rear gear hub 76, and is suitable journaled therein. On the rear side of the rear gear 66, the inner shaft 38 extends through the outer shaft 40 and is suitable journaled therein by a needle bearing 98 which supports the inner shaft 38 at the rear end of the outer shaft 40.

A first pair of seals 100 (e.g., oil seals) is interposed between the bearing casing 90 and outer propulsion shaft 40 at the rear end of the bearing casing 90. Likewise, a second pair of seals 102 (e.g., oil seals) is interposed between the inner shaft 38 and the outer shaft 40 at the rear end of the outer shaft 40. Lubricant within a lubricant sump 103 flows through the gaps between the bearing casing 90 and the outer shaft 40, and between the outer shaft 40 and the inner shaft 38 to lubricate the bearings 94, 96, 98, supporting the inner propulsion shaft 38 and the other propulsion shaft 40. The seals 100, 102 located at the rear ends of the bearing casing 90 and of the outer shaft 40 substantially prevent lubricant flow beyond these points.

With reference to FIG. 3, the front end of the inner propulsion shaft 38 includes a longitudinal bore 104. The bore 104 stems from the front end of the inner shaft 38 to a bottom surface 106 which is positioned on the rear side of the rear gear 66. The inner shaft 38 also includes a front aperture 108 that extends transverse to the axis of the longitudinal bore 104 and is generally symmetrically positioned between the front bevel gear 64 and the rear bevel gear 66. A rear aperture 110 also extends through the inner shaft 38, transverse to the axis of the longitudinal bore 104, at a position behind the rear bevel gear 66.

Figure 3A:
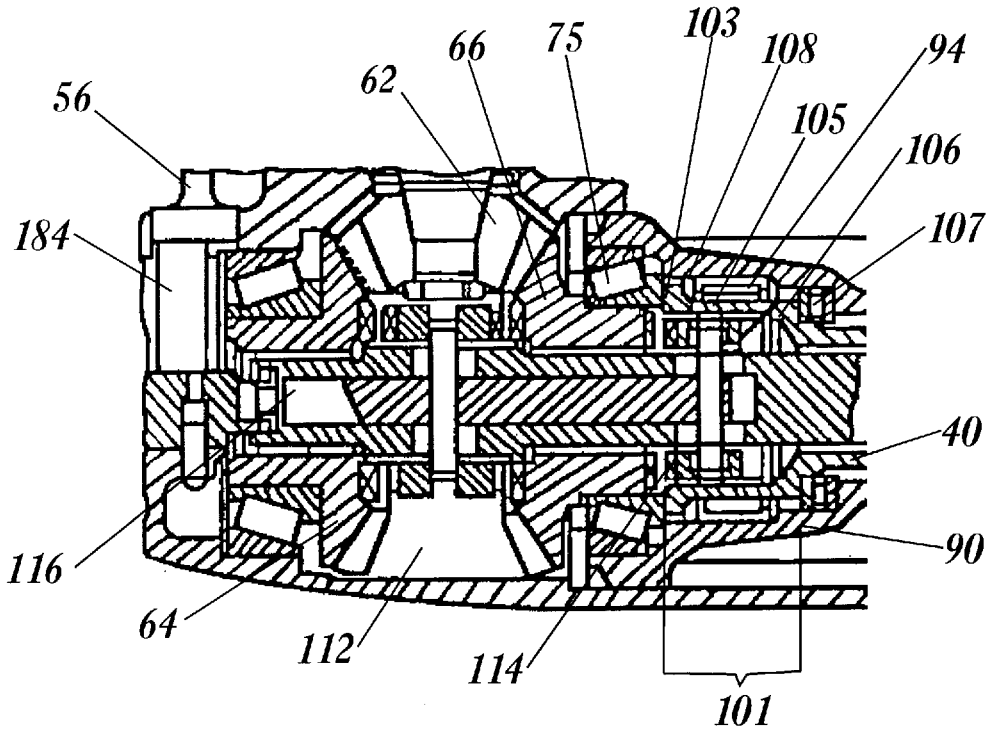
FIGS. 3*a* is a partial cross-sectional enlargement of the shifting mechanism of FIG. 3.

FIG. 3*a* is an enlarged partial cross-sectional view of the shifting mechanism. As in the previous figure, the outer propulsion shaft is identified by the reference numeral 40. A thrust flange is located on a forward side of the shaft 40 and is generally referenced by reference numeral 101. The thrust flange 101 includes a forward facing surface, or forward shoulder 103, adjacent to the first driven gear 66. A hollow rim 105 of the thrust flange 101 extends rearward from the shoulder 103 and overlaps clutch element 114. The rim 105 terminates at a rear facing surface, or shoulder 106, which also lies adjacent to thrust bearing 107.

The structure as described can support loads in opposite axial directions as is described below. For instance, the driving gear 62 will generate thrust loading on the driven gear 66 which, in turn, loads the shaft 40 in a direction along the drive axis toward the propeller 264. The shaft 40 in turn loads bearing 107 which loads the bearing carrier 90.

The structure also supports loading in the opposite direction. For example, if the thrust from the propeller creates a forward thrust loading on the shaft 40 that exceeds the rearward thrust loading of driving gear 62, a forward thrust force results. Under this type of loading, the propeller 264 imparts a forward load on the shaft 40 toward the front of the watercraft. The forward shoulder 103 of the thrust flange 101 then reacts against an inner race of the bearing 75 which in turn reacts against bearing carrier 90.

As illustrated in FIG. 3*a,* the outer propulsion shaft 40 is supported for rotation within the bearing carrier or housing 90. In particular, the thrust flange 101 is positioned adjacent to the bearing 75, 94 & 107 within the bearing carrier 90. The second bearing 94 is positioned in a recess 108 on an inside of the hollow rim 105 and at least partially journals the shaft 40 for rotation within the bearing carrier 90 between the bearing 75 and thrust bearing 107. The hollow rim portion 105 overlaps the clutch element 114 along the drive axis in this position. The clutch 112 is arranged with the gear 66 interposed between the clutch 112 and the clutch 114. Also, as described above, the thrust bearing 107 lies adjacent to the rearward shoulder 106 of the thrust flange 101 to support thrust type loading of the shaft 40.

Transmission Clutch Assembly

The transmission 36 includes a first dog clutch 112 and a second dog clutch 114 coupled to a plunger 116. As discussed in detail below, the front dog clutch 112 selectively couples the inner propulsion shaft 38 to either the front gear 64 or the rear gear 66. The rear dog clutch 114 selectively couples the outer propulsion shaft 40 to the rear gear 66.

The plunger 116 has a generally cylindrical rod shape and slides within the longitudinal bore 104 of the inner shaft 38 to actuate the clutches 112, 114. The plunger 116 may be solid; however, it is preferred that the plunger 116 be hollow (i.e., a cylindrical tube), especially where detent and shock absorbing mechanisms of the type described below are used.

At its front end, the plunger 116 terminates in a cylindrical disk-shaped head 118 which projects beyond the front end of the inner shaft 38. A reduced diameter neck portion 120 connects the head 118 to the plunger 116.

The plunger 116 includes a front hole 122 that is positioned generally transverse to the longitudinal axis of the plunger 116, and a rear hole 124 that is likewise positioned generally transverse to the longitudinal axis of the plunger 116. Each hole 122, 124 is desirably located symmetrically in relation to the corresponding apertures 108, 110 of the inner propulsion shaft 38.

The front dog clutch 112 has a spool-like shape and includes an axial bore 126 which extends between an annular front end plate 128 and an annular rear end plate 130. The bore is sized to receive the inner propulsion shaft 38.

The annular end plates 128, 130 of the front clutch 112 are substantially coextensive in size with the annular engagement surfaces 72, 78 of the front and rear gears 64, 66.

Teeth 132, 134 extend from each end plate 128, 130 in the longitudinal direction, as well as in a radial direction from the inner diameter to the outer diameter of the respective annular end plate 128, 130. As best seen in FIG. 4, the teeth 132, 134 desirably correspond to the respective teeth 70, 82 of the front and rear gears 64, 66, both in size (e.g., axial length) and in configuration. The teeth 132, 134 advantageously includes chamfers 136, 138 on the trailing edge of each tooth 132, 134 to ease engagement between the teeth 70, 82, 132, 134 of the gears 64, 68 and the front clutch 112, as known in the art.

With reference back to FIG. 3, the first dog clutch 112 has a spline connection 140 to the inner propulsion shaft 38 which establishes a drive connection between the clutch 112 and the shaft 38, yet permits the clutch 112 to slide along the axis of the shaft 38 between the front and rear gears 64, 66. The front dog clutch 112 specifically includes internal splines within the bore 126 that mate with corresponding external splines on the outer periphery of the inner propulsion shaft 38.

The front dog clutch 112 also includes a hole 142 that extends through the midsection of the clutch 112 in a direction generally transverse to the longitudinal axis of the clutch 112. The hole 142 is sized to receive a pin 144, which, when passed through the front aperture 108 of the inner propulsion shaft 38 and through front hole 122 of the plunger 116, interconnects the plunger 116 and the first dog clutch 112 with a portion of the inner shaft 38 interposed therebetween. The pin 144 may be held in place by a press-fit connection between the pin 144 and the front hole 122 of the plunger 116, or by a conventional coil spring (not shown) which is contained within a groove 146 about the midsection of the front dog clutch 112.

FIG. 3 illustrates the front dog clutch 112 set in a neutral position (i.e., in a position in which the clutch 112 does not engage either the front gear 64 or the rear gear 66). The clutch 112, in this neutral position, is spaced from the front gear 64 by a distance A, the importance of which is discussed below.

As seen in FIG. 3, the rear dog clutch 114 has a generally tubular shape and includes an axial bore 148 which extends between an annular front end plate 150 and an annular rear end plate 152. The bore 148 is sized to receive the inner propulsion shaft 38.

The annular front end plate 150 of the rear dog clutch 114 is substantially coextensive in area with the annular rear engagement surface 80 of the rear gear 66. Teeth 154 extend from the front end plate 150 in the longitudinal direction. Each tooth 154 also extends in a radial direction, from the inner diameter to the outer diameter of the end plate 150. As best seen in FIG. 4, the teeth 154 desirably correspond to the teeth 84 of the rear engagement surface 80 of the rear gear 66, both in size (e.g., axial length) and in configuration. The teeth 154 advantageously includes chamfers 156 on the trailing edges of each tooth 154 to ease engagement between the teeth 84 of the rear gear 66, as known in the art.

With reference back to FIG. 3, the rear dog clutch 114 includes a spline connection 158 to the outer propulsion shaft 40. External splines of the second dog clutch 114 matingly engage internal splines on the inner side of the hollow outer drive shaft 40. This spline connection 158 provides a driving connection between the rear clutch 114 and the outer propulsion shaft 40, as well as permits the rear clutch 114 to slide within the outer propulsion shaft 40 and over the inner shaft 38, as discussed below.

The rear dog clutch .114 also includes an internal annular groove 160. The internal groove 160 is desirably positioned symmetrically with respect to the longitudinal length of the rear dog clutch 114. The internal groove 160 is sized to receive a pin 162 which extends through the rear aperture 110 of the inner propulsion shaft 38 and through the rear hole 124 of the plunger 116 when assembled. Roller bearings 164 journal the pin 162 within the internal groove 160 of the rear dog clutch 114, as known in the art. In this manner, the rear clutch 114 is rotatably coupled to the plunger 116, while drivingly connected to the outer propeller shaft 40.

The pin 162 is inserted into the internal annular groove 160 through an aperture in the rear dog clutch 114. When assembled, the pin 162 is passed through the aperture and is inserted between the bearings 164, through the rear aperture 110 of the inner propulsion shaft 38 and through the rear hole 122 of the plunger 116. The pin 162 may be held in place by a press-fit connection between the pin 162 and the rear hole 122 of the plunger 116, or by a conventional coil spring (not shown) which is contained within a groove about the midsection of the rear dog clutch 114, as known in the art.

FIG. 3 illustrates the rear dog clutch 114 set in a neutral position (i.e., in a position in which the clutch 114 does not engage the rear gear 66). The clutch 114 in this neutral position is spaced from the rear gear 66 a distance B. The distance B is advantageously larger than the distance A by which the front clutch 112 is spaced from the front gear 64.

This nonuniform (i.e., unequal) spacial relationship between the front gear 64 and dog clutch 112 and the rear gear 66 and dog clutch 114 causes the front clutch 112 to engage the front gear 64 before the rear clutch 114 engages the rear gear 66. The staggered engagement decreases the shock on the transmission and clutch assembly, and permits quicker engagement between gears 64, 66 and clutches 112, 114 because, as discussed below, mutual, simultaneous engagement of the clutches 112, 114 and gears 64, 66 is not required.

With reference to FIG. 4, the corresponding teeth 70, 132 of the front gear 64 and front clutch 112 have a longer axial length than the corresponding teeth 84, 154 of the rear gear 66 and the rear clutch 114. This permits the front clutch 112 to slide toward to front gear 64 when the corresponding teeth 70, 132 are already partially engaged, so as to permit the rear clutch 114 to slide into engagement with the rear gear 66, as discussed below.

Actuator Mechanism

As noted above, the actuator mechanism 42 moves the plunger 116 of the clutch assembly 43 from a position in which the first and second dog clutches 112, 114 engage the first and second gears 64, 66, respectively, through a position of nonengagement (i.e., the neutral position), and to a position in which the first dog clutch 112 engages the second gear 66. The actuator mechanism 42 positively reciprocates the plunger 116 between these positions. FIGS. 2 and 3 best illustrate an exemplary embodiment of the actuator mechanism 42.

The actuator mechanism 42 connects the plunger 116 to the rotatable shift rod 56, which preferably depends in the vertical direction from the link 54. The link 54 in turn is coupled to and controlled by the gear shifter 44, by the known means described above. The actuator mechanism 42 desirable converts rotational movement of the shift rod 56 into linear movement of the plunger 116 to move the plunger 116 generally along the axis of the inner propulsion shaft 38.

With reference to FIG. 2, the actuator 42 includes a cam member 168 affixed to a lower end of the shift rod 56 and a follower member 170 connected to the plunger 116, as described below. Rotational movement of the cam member 168 produces linear movement of the follower member 170.

The cam member 168 includes a cylindrical upper bearing 172 and a smaller diameter, cylindrical lower bearing 174. The cylindrical bearings 172, 174 are substantially aligned along the axis of the shift rod 56 and, as seen in FIG. 3, are suitable journaled with an upper bore 176 and a lower bore 178 of the lower unit 24, respectively.

As best seen in FIG. 3, the cam member 168 includes a crank 180 positioned between the upper and lower cylindrical bearings 172, 174. The crank 180 is formed by an eccentrically positioned drive pin 182 interposed between an upper arm 184 and a lower arm 186. The drive pin 182 is eccentric relative to the axis of the shift rod 56. The upper arm 184 connects to the upper cylindrical bearing 172 and the lower arm 186 connects to the lower bearing 174.

The follower member 170, as seen in FIG. 2, has a generally cylindrical shape. An engagement recess 188 is formed within the follower member 170 and defines a pair of opposing, generally vertical surfaces 190. The engagement recess 188 is sized to receive a portion of the drive pin 182 of the cam member 168 which is positioned between the opposing surfaces 190 of the follower member 170.

The follower member 170 also includes a clearance recess 192 which is positioned below the engagement recess 188. The clearance recess 192 is formed with a sufficient size to permit the lower arm 186 of the crank 180 to pivot about the lower bearing 174.

For a similar purpose, the follower member 170 additionally includes a lower elongated slot 194 positioned below the clearance recess 192. The slot 194 has a sufficient width to receive the lower cylindrical bearing 174 and a sufficient length so as to permit reciprocation of the follower member 170, as discussed below.

The follower member 170 includes a yoke 196 integrally formed on its rear end. The yoke 196 desirably has cylindrical shape of reduced diameter which necks down from the follower member 170. The yoke 196 also includes a generally U-shaped aperture 198 which opens into a recess 200 from the rear end of the yoke 196. The recess 200 desirably has a generally cylindrical shape. The lateral width of the aperture 198 is advantageously less than the diameter of the recess 200. When assembled, the recess 200 receives the head 118 of the plunger 116 with the reduced diameter neck 120 of the plunger 116 inserted through the aperture 198 of the yoke 196. In this manner, the follower member 170 and the plunger 116 are interconnected. This connection permits the follower member 170 to transmit linear movement to the plunger 116, while permitting the plunger 116 to rotate relative to the follower member 170.

The follower member 170 is slidably supported in a recess 202 formed at the front end of the lower unit 24. The front recess 202 has a length in the longitudinal direction sufficient to permit the follower member 170 to reciprocate in the longitudinal direction, as described below.

Shock Absorber Mechanism

Figure 5:
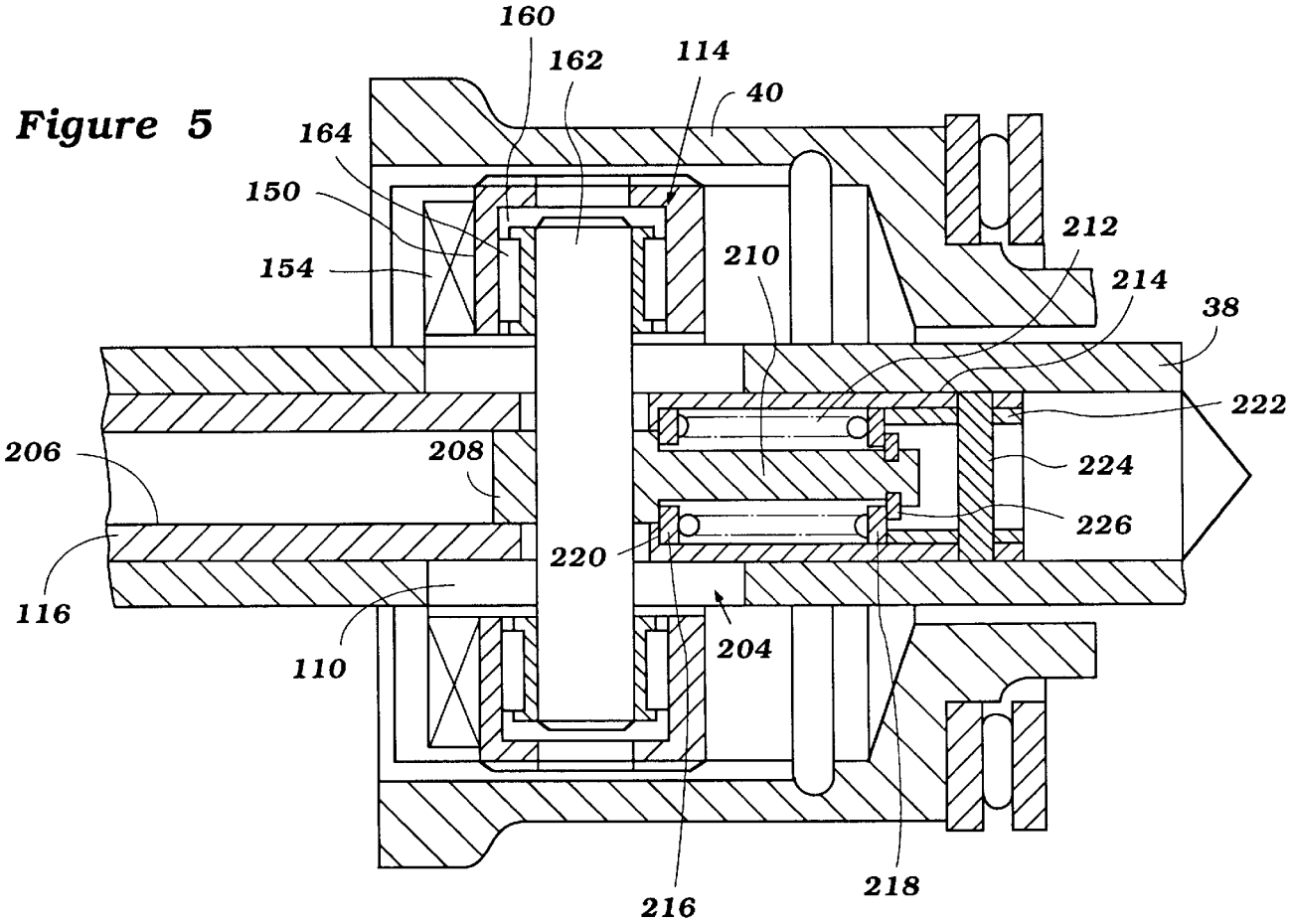
FIG. 5 is an enlarged sectional view of a shock absorber mechanism which may be used with the shifting mechanism of FIG. 3.

The shifting mechanism 12 may include a shock absorber mechanism 204, such as that illustrated in FIG. 5. In the illustrated embodiment, the shock absorber mechanism 204 is used in conjunction with the rear clutch 114; however, it is understood that the shock absorber mechanism 204 could additionally or alternatively be used with the front clutch 112. It is further understood that the shock absorber mechanism 204 could be used where distance A (the distance between the front gear 64 and the front clutch 112) equals distance B (the distance between the rear gear 66 and the rear clutch 114). In this case, the shock absorber 204 permits one clutch to engage before the other, as described below.

In the embodiment illustrated in FIG. 5, the shock absorber mechanism 204 interconnects the plunger 116 with the pin 162 used to couple the plunger 116 to the rear dog clutch 114. The shock absorber mechanism 204 is disposed at the rear end of the plunger 116, within an inner bore 206 of the hollow plunger 116.

The shock absorber 204 includes a piston 208 which is slidably supported within inner bore 206 of the of the hollow plunger 116 on either side of the rear hole 124. A piston rod 210, integrally formed with the piston 208, extends rearward, in the longitudinal direction. The piston rod 210 extends through a helical compression spring 212.

The spring 212 is contained within a counterbore 214 that extends into the hollow plunger 116 from the rear end. A front washer 216 and a rear washer 218 sandwich the spring 212 in a preloaded condition.

The front washer 216 rests against a bottom step 220 formed by the counterbore 214 and has an inner diameter larger than the diameter of the piston rod 210. The piston rod 210 thus passes freely through the front washer 216.

The rear washer 218 likewise has an inner diameter larger than the diameter of the piston rod 210 such that the piston rod 210 extends freely through the rear washer 218. The outer diameter of the rear washer 218 desirably matches that of the counterbore 214.

An inner sleeve 222 secures and positions the rear washer 218 within the counterbore 214. The sleeve 222 has an outer diameter substantially equal to the diameter of the counterbore 214, and has an inner diameter larger than the inner diameter of the rear washer 218. A pin 224, which passes through aligned transverse holes in plunger 116 and inner sleeve 222, affixes the inner sleeve 222 within the counterbore 214 of the plunger 116.

A conventional e-ring 226 is attached to the rear end of piston rod 210 to prevent the rod 210 from sliding through the rear washer 218. The e-ring 226 fits within an annular groove (not shown) which circumscribes the piston rod 210 proximate to its rear end.

The shock absorber mechanism 204 may support the pin 162 in a manner which permits the shock absorber to move either forward or rearward. For this purpose, the piston 208 positions the pin 162 generally at the middle of the rear aperture 110 of the inner propulsion shaft 38. This arrangement is particular well suited for use with a clutch disposed between opposing gears (e.g., the front clutch 112 disposed between the counter-rotating drive gears 64, 66). It should also be appreciated that the rear aperture 110 could be smaller than that illustrated in FIG. 5, such that the pin abuts a front edge of the rear aperture 110. This latter arrangement is well suited where the clutch engages the corresponding gear in the forward direction only (e.g., the rear gear 114 engages the rear gear 66 in the forward direction).

Detent Mechanisms

The present outboard drive may additionally include a detent mechanism 228 to hold the plunger 116 (and coupled clutches 112, 114) in the neutral position, as well as include a detent mechanism 230 to accelerate the plunger 116 (and clutches 112, 114) in the direction of actuation.

Figure 6:
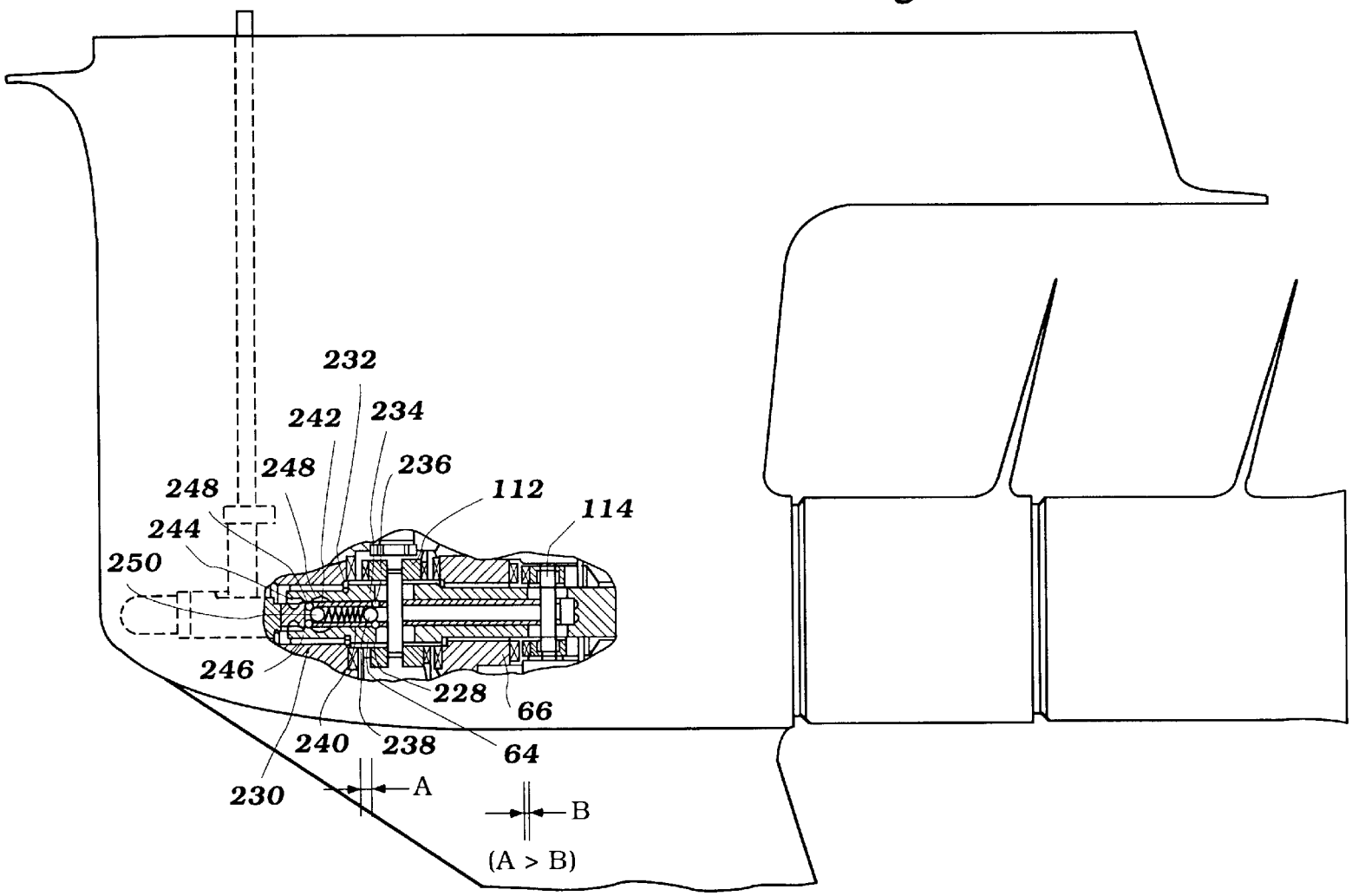
FIG. 6 is a partial, sectional, side elevational view of a marine outboard motor incorporating a shifting mechanism in accordance with another preferred embodiment of the present invention and a detent mechanism.

FIG. 6 illustrates the neutral detent mechanism 228 used with the hollow plunger 116. This detent mechanism 228 may be used with the present shifting mechanism 12 or with an alternative preferred embodiment of the shifting mechanism which is described below and also illustrated in FIG. 6. The neutral detent mechanism 228 is similar to that disclosed in U.S. Pat. No. 4,570,776 issued to Iwashita et al., which is hereby incorporated by reference.

The neutral detent mechanism 228 is formed in part by at least one, and preferably two transversely positioned holes 232 in the hollow plunger 116. These holes 232 receive detent balls 234. The detent balls 234 have a diameter slightly smaller than diameter of the holes 232.

The inner propulsion shaft 38 includes detent recesses 236 formed on the inner wall of the bore 104 through which the plunger 116 slides. The recesses 236 on the inner propulsion shaft 38 are positioned so as to properly locate the dog clutches 112, 114 in the neutral position when the detent holes 232 of the plunger 116 are aligned in the vertical direction with the detent recesses 236 of the inner propulsion shaft 38.

A ball plunger, formed by a larger ball 238 and a helical compression spring 240, biases the detent balls 234 radially outward, against the inner wall of the inner propulsion shaft bore 104. The plunger 116 contains the ball 238 and spring 240 within its bore 206 with the ball 238 sliding therein. For this purpose, the ball 238 has a diameter slightly smaller that the diameter of the bore 206 of the hollow plunger 116.

The large ball 238 slides rearward and forces portions of the detent balls 234 into the corresponding detent recesses 236 when the plunger 116 is moved into the neutral position. The spring force acting on the large ball 238 urges the large ball rearward and thus biases the detent balls 234 into this position. This releasably connection between the detent balls 234 of the plunger 116 and the detent recess 236 of the inner propulsion shaft 38 releasably restrains movement of the plunger 116 relative to the inner propulsion shaft 38.

As also seen in FIG. 6, the accelerating detent mechanism 230 may also be incorporated into the shifting mechanism 12. The accelerating detent mechanism 230 is desirably spaced from the neutral detent mechanism 228 in the longitudinal direction.

Similar to the neutral detent mechanism 228, the accelerating detent mechanism 230 is formed in part by at least one, and preferably two transversely positioned holes 242 in the hollow plunger 116. These holes 242 receive detent balls 244. The detent balls 244 have a diameter slightly smaller than diameter of the holes 242.

The inner propulsion shaft 38 includes at least one, and preferably two diametrically opposing narrow lands 246. Each land 246 has a longitudinal length substantially equal to the diameter of a detent ball 244. The lands 246 desirably align with the detent holes 242 of the plunger 116 when the plunger 116 and dog clutches 112, 114 are positioned in the neutral position.

Each land 246 is interposed between a pair of cam surfaces 248 which extend into the wall of the inner propulsion shaft 38. The cam surfaces 248 advantageously are inclined flat surfaces which form part of a relief that extends into the inner wall of the propulsion shaft bore 104. In the illustrated embodiment, the cam surfaces 248 are inclined relative to the vertical axis by about 450; however, it is understood that the degree of inclination could be tailored to suit specific applications of the accelerating detent mechanism 230.

A larger ball 250, biased by the helical compression spring 240, urges the detent balls 244 radially outward, against the inner wall of the inner propulsion shaft bore 104. The plunger 116 slidably contains the ball 250 within the bore 104. The function of the accelerating detent mechanism 230 is described in U.S. Pat. No. 4,570,776, which has been incorporated by reference.

Propulsion Device

The above-described transmission and clutch assembly is particularly suited for use with counter-rotating propellers 58, 60. It is contemplated, however, that those skilled in the art will readily appreciate that the present shifting mechanism 12 could be used with other types of propulsion drives as well;

In the illustrated embodiment of FIG. 3, the inner shaft 38, on the rear side of the rear end of the outer shaft 40, tapers in diameter towards its rear end 252. The rear end 252 of the inner shaft 38 has a smaller diameter than the portion of the inner shaft 38 supported within the outer shaft 40.

The tapered rear end 252 of the inner shaft 38 carries an engagement sleeve 254 having a spline connection with the tapered rear end 252 of the inner shaft 38. The sleeve 254 is fixed to the inner shaft rear end 252 between a nut 256 threaded on the rear end of the shaft 38 and an annular retainer ring 258 that engages the tapered section of the inner shaft 38 proximate to the rear end of the outer shaft 40.

The inner shaft 38 also carries a first propeller boss 260. An elastic bushing 262 is interposed between the engagement sleeve 254 and the propeller boss 260 and is compressed therebetween. The bushing 262 is secured to the engagement shaft 254 by a heat process known in the art. The frictional engagement between the boss 260, the elastic bushing 262, and the engagement sleeve 254 is desirably sufficient to transmit rotational forces from the sleeve 254 to the propeller 58 attached to the propeller boss 260.

The propeller boss 260 has an inner sleeve 263 and an outer sleeve 264 to which the propeller blades 58 are integrally formed A plurality of radial ribs 266 extend between the inner sleeve 262 and the outer sleeve 264 to support the outer sleeve 264 about the inner sleeve 262 and to form passages 268 through the propeller boss 260. Engine exhaust is exhausted through these passages 268 in the propeller boss 260, as known in the art and as described below.

The outer shaft 40 carries the second propeller 60 in a similar fashion. As best seen in FIG. 3, the rear end portion of the outer shaft 40 carries a second engagement sleeve 270 in, driving engagement thereabout by a spline connection. The second engagement sleeve 270 is captured onto the shaft 40 between the annular retaining ring 258 and the front end ring 92.

A second annular elastic bushing 272 surrounds the second engagement sleeve 270. The bushing 272 is secured to the sleeve 270 by heat process known in the art.

A second propeller boss 274 surrounds the elastic bushing 272, which is held under pressure between the boss 274 and the sleeve 270 in frictional engagement. The frictional engagement between the propeller boss 274 and the bushing 272 is sufficient to transmit a rotational force from the sleeve 270 to the second propeller 60 attached to the second propeller boss 274.

Similar to the first propeller boss 260, the second propeller boss 274 has an inner sleeve 276 and an outer sleeve 278. The propeller blades of the second propeller 60 are integrally formed on the exterior of the outer sleeve 278. Ribs 280 interconnect the inner sleeve 276 and the outer sleeve 278 and form axially extending passages 282 between the sleeves 276, 278, that communicate with an exhaust passage 284 in the lower unit 24 and with the passages 268 of the first propeller boss 260, as conventionally known.

Shifting of Outboard Drive

The following elaborates on the previous description of the function of the present shifting mechanism 12 with reference to FIGS. 3 and 7–9. In the illustrated embodiment of FIG. 3, to engage the drive shafts 38, 40 with the propellers 58, 60, the gear shift lever 46 is moved from a neutral position to a forward position. The shift rod 56 rotates in response which causes the crank 180 attached to its lower end to rotate in the forward direction. Forward rotation of the cam member 168 moves the follower member 170 forward. The yoke connection between the follower member 170 and the plunger 116 moves the plunger 116 in the forward direction in response to forward movement of the follower member 170.

Figure 7:
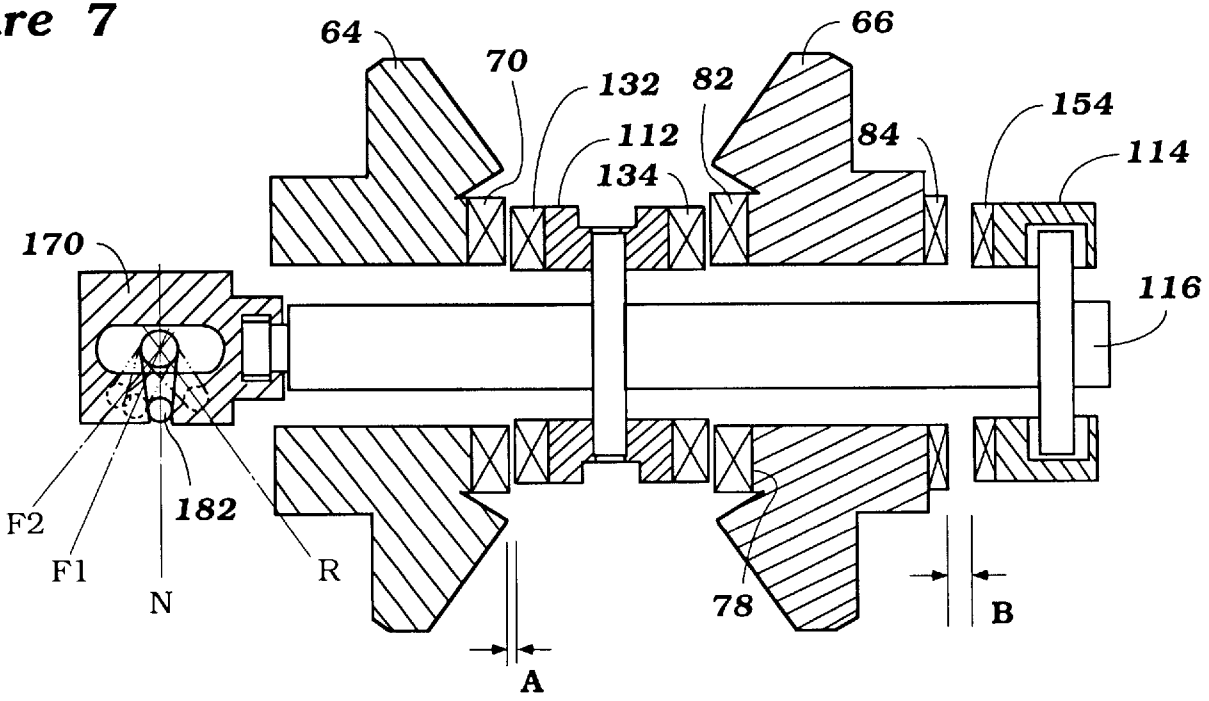
FIG. 7 is a schematic illustration of the clutch assembly and actuator mechanism of FIG. 3.

FIG. 7 schematically illustrates the front and rear clutches 112, 114 positioned in the neutral position. In the neutral position, the drive pin 182 of the cam member 168 is positioned at point N. The-drive pin 182 moves forward in response to the gear shift lever 46 being moved forward, as described above.

Figure 8:
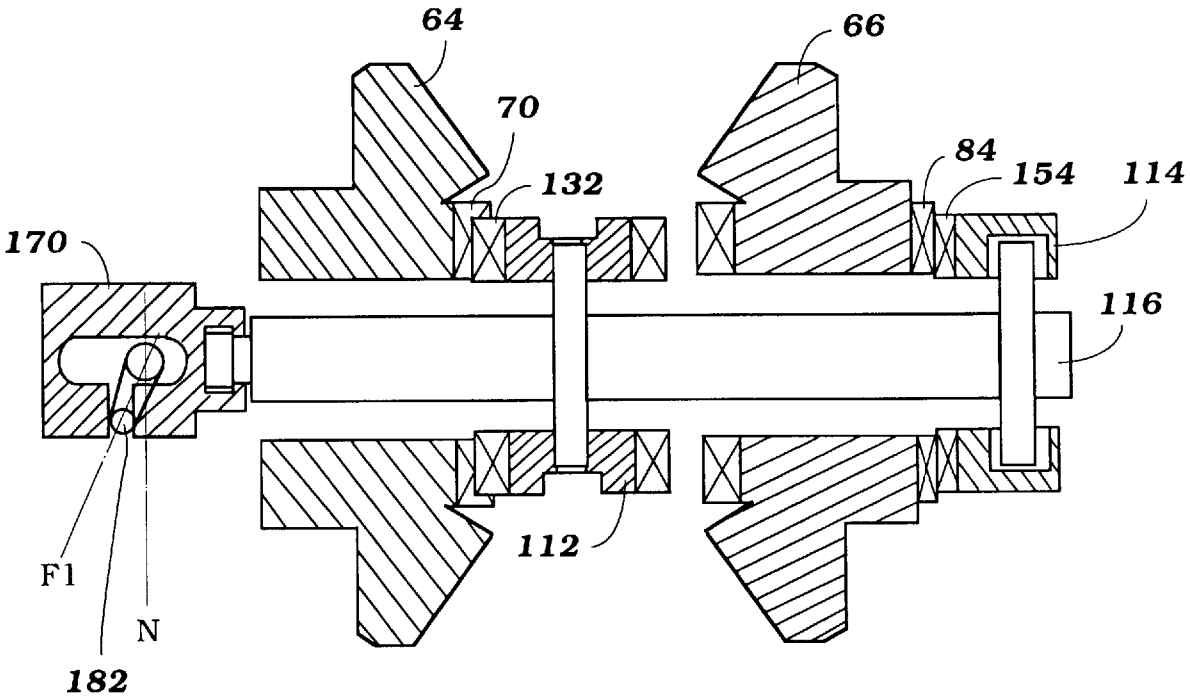
FIG. 8 is a schematic illustration of the clutch assembly and actuator assembly of FIG. 3, illustrating initial engagement between the forward gear and the forward clutch.

Initially, as illustrated in FIG. 8, the teeth 132 of front clutch 112 engage the corresponding teeth 70 of the front gear 64. The front clutch 112 engages without the rear gear engaging because of the unequal spacing between the front and rear clutches 112, 114 and the front and rear gears 64, 66. Less mechanical shock is thus placed on the transmission 36 during this initial engagement.

The drive pin 182 is positioned at Point F1 with the front clutch 112 engaging the front gear 64. At this point, rotation of the front gear 64 is transmitted to the inner propulsion shaft 38 which rotates the first propeller 58. The first propeller 50 desirably produces a forward thrust when driven in this direction.

Figure 9:
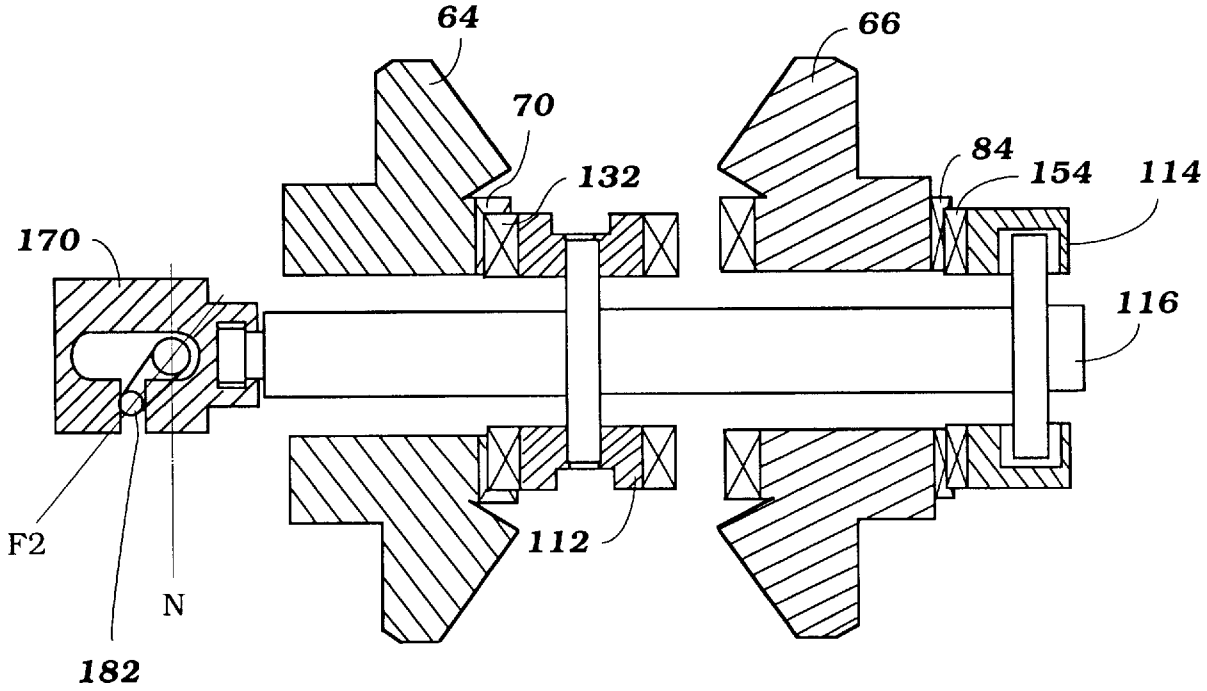
FIG. 9 is a schematic illustration of the clutch assembly and actuator mechanism of FIG. 3, illustrating full engagement between the forward gear and clutch, and between the rear gear and clutch.

Further forward movement of the plunger 116 in response to forward movement of the drive pin 182 causes the rear clutch 114 to engage the rear gear 66. FIG. 9 schematically illustrates the rear clutch 114 engaged with the rear gear 66. The front clutch 112, in this position, is also fully engaged with the front gear 64. As mentioned above, the length of the teeth 70, 132 of the front gear 64 and front clutch 112 permits this further engagement so that the rear clutch 114 can engage with the rear gear 66. As FIG. 9 illustrates, the drive pin 182 and follower member 170 are positioned in the F2 position with the clutches 112, 114 fully engaging the gears 64, 66.

Although mechanical shock occurs when the rear clutch 114 engages the rear gear 66, the shock is reduced compared to prior shifting mechanisms because the front clutch 112 has already engaged the front gear 64. Thus, by staggering the engagement of the clutches 112, 114, the associated mechanical shock is separated, reducing the amount of shock experienced by the system at one time.

To further reduce mechanical shock when the rear clutch 114 engages the rear gear 66, the shifting mechanism 12 may include the shock absorber mechanism 204 described above. If the plunger 116 forces the rear clutch 114 into engagement with the rear gear 64 when the corresponding teeth 154, 84 are out of phase, as illustrated in FIG. 4*a*, the teeth 154, 84 will not initially engage and an axial force will result because of this collision.

The axial force causes the piston 208 supporting the rear clutch 114 to compress the spring 212 of the shock absorber 204. The spring 212 thus absorbs some of the energy of the collision, and, to some extent, decouples the plunger 116 from the shock transmitted through the rear clutch 114.

Figure 4B:
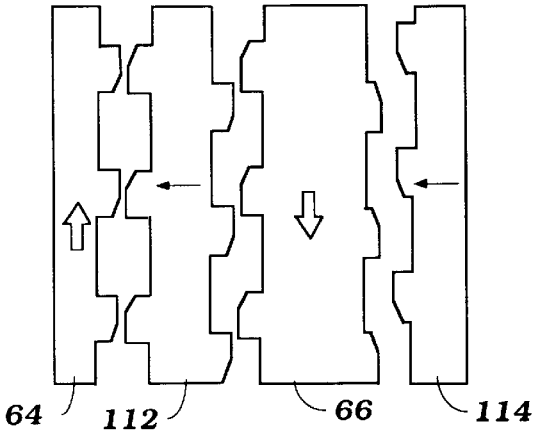
FIG. 4*b* is another abbreviated developed view of the clutches and gears of FIG. 4*a,* illustrating misalignment between a front clutch and a front gear.
Figure 4C:
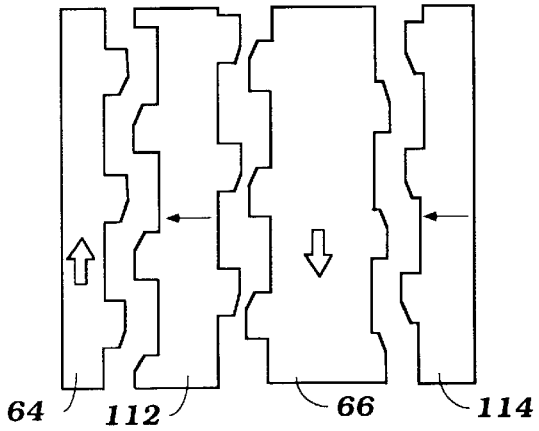
FIG. 4*c* is a further abbreviated developed view of the clutches and gears of FIG. 4*a,* illustrating mutual and synchronized alignment between the front clutch and gear, and the rear clutch and gear.

When the teeth 84, 154 of the rear gear 61 and rear clutch 114 are rotated into registry, as illustrated in FIG. 4*b,* the clutch 114 can engage the rear gear 66. The compressed spring 212 specifically forces the clutch 114 toward the rear gear 66. In this manner, the clutch 114 couples the outer propulsion shaft 40 to the rear gear 66 when engaged.

As noted above, the staggered engagement process quickens the engagement period because synchronization of both the teeth 70, 132 of the front gear 64 and front clutch 112, and the teeth 84, 154 of the rear gear 66 and rear clutch 114 are not required. With prior shifting mechanisms, as noted above, the engagement of the clutches require synchronized registration of the front clutch/gear pairing and the rear clutch/gear pairing because engagement occurred simultaneously. Thus, the gears would not engage under the conditions illustrated in FIG. 4*a* and 4*b*. Only when both the teeth of the front gear and clutch, and the rear gear and clutch are in phase will clutch engagement occur. With the present shifting mechanism 12, engagement of the front clutch 112 is not dependent on engagement of the rear clutch 114. Rear clutch engagement occurs only after front clutch has engaged. Thus, synchronization is not required and the engagement process is quickened.

It is understood that the same advantages accrue where the distance A between the front gear 64 and the front clutch 112 is greater than the distance B between the rear gear 66 and the rear clutch 114, as illustrated in the alternative preferred embodiment of FIG. 6. Of course, in this arrangement, the rear clutch 114 would engage before the front clutch 112 would engage. It is contemplated that those skilled in the art will readily adapt either embodiment to suit specific applications.

It should also be noted that the same advantages accrue where the shock absorber mechanism 212 is used alone (i.e., where A=B). The shock absorber mechanism 212 permits the clutches 112, 114 to engage the respective gears 64, 66 independently of each other, because the shock absorber 212 allows the plunger 116 to move in the direction of actuation without the gear and clutch teeth being registered. The front clutch 112 engages when its teeth 132 are registered with the teeth 70 of the front gear 64. Likewise, the rear clutch 114 engages when its teeth are registered with the teeth of the rear gear. The engagement of the clutches 112, 114 occur independently of each other, and in most cases, occur sequentially, rather than simultaneously.

When the front and rear clutches 112, 114 are fully engaged, the drive shaft 34 drives the both the inner propulsion shaft 38 and the outer propulsion shaft 40. Specifically, the drive shaft drives the drive bevel gear (62 of the transmission 36. Rotation of the drive bevel gear 62 is transmitted to the driven front bevel gear 64 to rotate the first propeller 58 as described above. The drive bevel gear 62 also transmits rotation to the driven rear bevel gear 66, which rotates in a direction opposite from that of the front bevel gear 64. In this manner, the outer drive shaft 40 rotates the second propeller 60 in a rotational direction opposite that of the first propeller 58.

To disengage the drive shaft 34 from the propulsion shafts 38, 40, the gear shift lever 46 is moved from the forward position to a rearward position. As described above, the drive pin 182 moves rearward in response, which positively moves the plunger 116 rearward. The plunger 116 forces the clutches 112, 114 out of engagement with the gears 64, 66 and moves the front clutch 112 into engagement with the front engagement surface 78 of the rear gear 66.

The rear gear 66, which rotates in an opposite direction to the front gear 64, drives the inner shaft 38 in an opposite direction. The inner shaft 38 thus rotates the first propeller 58 in the opposite direction which produces a reverse thrust on the watercraft 14, as known in the art.

Although this invention has been described in terms of certain preferred embodiments, other embodiments apparent to those of ordinary skill in the art are also within the scope of this invention. Accordingly, the scope of the invention is intended to be defined only by the claims that follow.

What is claimed is:

1. A transmission for a marine outboard drive comprising a first driven gear and a corresponding first clutch coupled to a first propulsion shaft, a second clutch positioned with said first driven gear interposed between said first clutch and said second clutch said first driven gear being supported by a first bearing assembly, said propulsion shaft extending through a bearing carrier along a drive axis with a second bearing assembly journalling a portion of said first propulsion shaft within said bearing carrier, said first propulsion shaft including at least one thrust flange positioned between said first bearing assembly and a third bearing assembly, said thrust flange of said first shaft is arranged to act against said first bearing assembly and against said third bearing assembly to take thrust loadings in opposite axial directions.

2. A transmission as in claim 1, wherein said thrust flange of said first shaft is arranged to load said first bearing assembly in an opposite axial direction from the loading applied by said first driven gear.

3. A transmission as in claim 1, wherein said first bearing assembly comprises at least one thrust bearing.

4. A transmission as in claim 1, wherein said first driven gear includes a bearing hub which is supported by said first bearing assembly, said bearing hub including a plurality of positive clutching elements positioned on its end which are configured to engage said first clutch.

5. A transmission as in claim 1, wherein said first bearing assembly supports at least a portion of said first driven gear within said bearing carrier.

6. A transmission as in claim 1, wherein said thrust flange comprises a hollow rim portion interposed between a front facing surface and a rear facing surface.

7. A transmission for a marine outboard drive comprising a first driven gear supported by a first bearing assembly, a corresponding first clutch which is coupled to a first propulsion shaft of said outboard drive to selectively couple said first propulsion shaft to said first driven gear, said propulsion shaft having a hollow rim which surrounds at least a portion of said clutch and which terminates at a forward portion of a thrust flange positioned proximate to said driven gear and arranged so as to load said first bearing assembly, and a second bearing assembly which supports said rim of said first propulsion shaft, said second bearing assembly being positioned directly behind said forward portion of said thrust flange.

8. A transmission as in claim 7, wherein said second bearing assembly is disposed within a recess of a housing through which said first propulsion shaft extends along a drive axis, said second bearing assembly being located within said housing in a position which generally corresponds to the position of said first clutch along said drive axis.

9. A transmission as in claim 8, wherein said first bearing assembly supports at least a portion of said first driven gear within said housing.

10. A transmission as in claim 7, wherein said first bearing assembly comprises at least one thrust bearing.

11. A transmission for a marine outboard drive comprising a first driven gear and a corresponding first clutch coupled to a first propulsion shaft, said first driven gear being supported by a first bearing assembly, said propulsion shaft extending through a bearing carrier along a drive axis with a second bearing assembly disposed within said bearing carrier at a position that overlaps the position of said first clutch along said drive axis, said second bearing assembly journalling a portion of said first propulsion shaft within said bearing carrier, said first propulsion shaft including at least one thrust flange positioned between said first bearing assembly and a third bearing assembly, said thrust flange of said first shaft is arranged to act against said first bearing assembly and against said third bearing assembly to take thrust loadings in opposite axial directions.

12. A transmission as in claim 11, wherein said thrust flange of said first shaft is arranged to load said first bearing assembly in an opposite axial direction from the loading applied by said first driven gear.

13. A transmission as in claim 11, wherein said first bearing assembly comprises at least one thrust bearing.

14. A transmission as in claim 11, wherein said first driven gear includes a bearing hub which is supported by said first bearing assembly, said bearing hub including a plurality of positive clutching elements positioned on its end which are configured to engage said first clutch.

15. A transmission as in claim 11, wherein said first bearing assembly supports at least a portion of said first driven gear within said bearing carrier.

16. A transmission as in claim 11, wherein said thrust flange comprises a hollow rim portion interposed between a front facing surface and a rear facing surface.

17. A transmission for a marine outboard drive comprising a first driven gear and a corresponding first clutch coupled to a first propulsion shaft, said first driven gear being supported by a first bearing assembly, said propulsion shaft extending through a bearing carrier along a drive axis with a second bearing assembly journalling a portion of said first propulsion shaft within said bearing carrier, said first propulsion shaft including at least one thrust flange positioned between said first bearing assembly and a third bearing assembly, said thrust flange of said first shaft is arranged to act against said first bearing assembly and against said third bearing assembly to take thrust loadings in opposite axial directions and wherein said second bearing assembly is arranged between the first bearing assembly and the third bearing assembly.

18. A transmission as in claim 17, wherein said thrust flange of said first shaft is arranged to load said first bearing assembly in an opposite axial direction from the loading applied by said first driven gear.

19. A transmission as in claim 17, wherein said first bearing assembly comprises at least one thrust bearing.

20. A transmission as in claim 17, wherein said first driven gear includes a bearing hub which is supported by said first bearing assembly, said bearing hub including a plurality of positive clutching elements positioned on its end which are configured to engage said first clutch.

21. A transmission as in claim 17, wherein said first bearing assembly supports at least a portion of said first driven gear within said bearing carrier.

22. A transmission as in claim 17, wherein said thrust flange comprises a hollow rim portion interposed between a front facing surface and a rear facing surface.

* * * * *